US009617867B2

(12) United States Patent
Maekawa et al.

(10) Patent No.: US 9,617,867 B2
(45) Date of Patent: Apr. 11, 2017

(54) GAS TURBINE

(71) Applicant: Mitsubishi Hitachi Power Systems, Ltd., Nishi-ku, Yokohama (JP)

(72) Inventors: Hayato Maekawa, Tokyo (JP); Kenji Nanataki, Tokyo (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 494 days.

(21) Appl. No.: 14/078,770

(22) Filed: Nov. 13, 2013

(65) Prior Publication Data

US 2014/0205445 A1 Jul. 24, 2014

(30) Foreign Application Priority Data

Jan. 23, 2013 (JP) ..... 2013-010031

(51) Int. Cl.
*F01D 11/12* (2006.01)
*F01D 11/00* (2006.01)

(52) U.S. Cl.
CPC ..... *F01D 11/122* (2013.01); *F01D 11/001* (2013.01); *F05D 2220/3212* (2013.01); *F05D 2300/61* (2013.01)

(58) Field of Classification Search
CPC ..... F01D 11/01; F01D 11/122; F01D 11/001; F05D 2300/61; F05D 2300/612; F05D 2220/3212
See application file for complete search history.

(56) References Cited

U.S. PATENT DOCUMENTS 5,429,478 A * 7/1995 Krizan ..... F01D 11/001 415/115
5,522,698 A * 6/1996 Butler ..... F01D 11/001 277/355
6,189,891 B1 * 2/2001 Tomita ..... F01D 11/001 277/414
7,287,957 B2 10/2007 Jahns et al.
(Continued)

FOREIGN PATENT DOCUMENTS

CN 1932249 A 3/2007
CN 101131101 A 2/2008
(Continued)

OTHER PUBLICATIONS

Chinese Office Action issued in counterpart Chinese Application No. 201310524927.0 dated Oct. 10, 2015 (10 pages).
(Continued)

*Primary Examiner* — Igor Kershteyn
(74) *Attorney, Agent, or Firm* — Crowell & Moring LLP

(57) ABSTRACT

A gas turbine includes a disk wheel forming a rotor; a rotor blade including a shank mounted on the outer circumference of the disk wheel and a rotor blade profile portion; a stator blade including a stator blade profile portion and an inner circumferential end wall provided on the inner circumferential side of the stator blade profile portion; and a seal fin provided on the shank of the rotor blade so as to face an inside-diameter surface of the inner circumferential end wall of the stator blade. An abradable coating is applied to such a portion of the inside-diameter surface of the inner circumferential end wall of the stator blade that faces the seal fin.

5 Claims, 4 Drawing Sheets

(56) References Cited

U.S. PATENT DOCUMENTS

| | | | | |
|---|---|---|---|---|
| 8,979,481 | B2 * | 3/2015 | Ingram | F01D 11/04 415/115 |
| 2007/0224035 | A1 | 9/2007 | Nigmatulin | |
| 2007/0273104 | A1 | 11/2007 | Kovac et al. | |
| 2008/0044284 | A1 | 2/2008 | Alvanos | |
| 2008/0056889 | A1 | 3/2008 | Cheng et al. | |
| 2008/0124215 | A1 | 5/2008 | Paolillo et al. | |
| 2009/0238683 | A1 | 9/2009 | Alvanos et al. | |
| 2013/0200571 | A1 | 8/2013 | Mutou et al. | |

FOREIGN PATENT DOCUMENTS

| | | | |
|---|---|---|---|
| EP | 0 183 638 | A1 | 6/1986 |
| EP | 1 895 108 | A2 | 3/2008 |
| EP | 2 105 581 | A2 | 9/2009 |
| JP | 6-159099 | A | 6/1994 |
| JP | 9-511303 | A | 11/1997 |
| JP | 9-512607 | A | 12/1997 |
| JP | 10-252412 | A | 9/1998 |
| JP | 2010-151267 | A | 7/2010 |
| JP | 2011-196356 | A | 10/2011 |
| WO | WO 2011/118474 | A1 | 9/2011 |

OTHER PUBLICATIONS

Extended Europeans Search Report dated Mar. 18, 2014 (nine (9) pages).

Japanese-language Office Action issued in counterpart Japanese Application No. 2013-010031 dated Sep. 6, 2016 (4 pages).

European Office Action issued in counterpart European Application No. 13192770.9 dated Oct. 20, 2016 (Four (4) pages).

* cited by examiner

GAS TURBINE

BACKGROUND OF THE INVENTION

1. Field of the Invention

The present invention relates to a gas turbine, more specifically the gas turbine equipped with a sealing device for preventing combustion gas from entering a wheel space.

2. Description of the Related Art

In a gas turbine including a compressor, a combustor, and a turbine, air compressed by the compressor is burned to be high-temperature combustion gas along with fuel after the compressed gas is supplied to the combustor. This combustion gas passes through the turbine to expand therein, which rotates a rotor blade rotating together with a rotor, thereby rotating a shaft.

The rotor blade of the turbine exposed to the high-temperature combustion gas is designed with high-temperature-resistant specifications. Since the rotor is not designed with such specifications, it is necessary to prevent the high-temperature combustion gas from entering the wheel space, which can be achieved, for example, by installing a seal fin on a rotor blade shank portion, and then supplying pressurized air from the compressor to the wheel space to purge the combustion gas.

The sealing device as above includes a gas turbine sealing device whose seal portion is configured from the seal fin and a honeycomb seal in order to reduce an amount of cooling air leaking toward a high-temperature combustion gas side, thereby preventing performance degradation of the gas turbine. The seal fin is provided on the upper portion of a seal plate that is mounted on an end of a platform of the rotor blade. The honeycomb seal is located on a bottom surface of an end of an inside shroud of a stator blade. Refer to JP-10-252412-A.

SUMMARY OF THE INVENTION

Under the above-mentioned technology of JP-10-252412-A, a plurality of the seal fins opposed to the honeycomb seal are provided on an upper portion of the seal plate located on a lower portion of the platform of the rotor blade so as to be tilted with respect to flow of outflow air. The tilt increases resistance of the air about to flow out so as to improve sealing performance, which enables to prevent the performance degradation of the gas turbine as a result.

Incidentally, the honeycomb seal is formed by joining a honeycomb material to the bottom surface of the end portion of the inside shroud of the stator blade by brazing that utilizes e.g. a Ni-blazing filler material. The Ni-blazing filler material melts at a temperature of as high as approximately 1000° C. to fixedly join the honeycomb material to the bottom surface of the end portion of the inside shroud. For this reason the honeycomb seal is frequently applied to relatively low temperature portions such as a third stage and a fourth stage of the turbine. An issue of the honeycomb seal is it is difficult to apply the honeycomb seal to an upstream side, i.e., high-temperature portions such as a first and a second stage of the turbine to which the high-temperature combustion gas is led.

The present invention has been made in view of such situations and it aims to provide a gas turbine equipped with a sealing device that can enhance sealing performance even at a high-temperature portion on the upstream side of a turbine.

According to an aspect of the present invention to solve such problems as above, provided is a gas turbine that includes disk wheels of which a rotor is formed; a rotor blade including a shank and a rotor blade profile portion, the shank being mounted on the outer circumference of each of the disk wheels; a stator blade including a stator blade profile portion and an inner circumferential end wall provided at the stator blade profile portion on the side of the inner circumference of the stator blade profile portion; and a seal fin provided on the shank of the rotor blade in such a manner that the seal fin faces an inside-diameter surface lying on the inner circumferential end wall of the stator blade; wherein an abradable coating is applied to a portion of the inside-diameter surface lying on the inner circumferential end wall of the stator blade and facing the seal fin on the shank.

According to the present invention, on the upstream side of a turbine portion the seal fin is provided on the shank portion of the rotor blade as a rotating body and a ceramic abradable coating is applied to the inside-diameter surface of the inner circumferential end wall of the stator blade as a stationary body opposed to the seal fin. Thus, the seal performance can be enhanced even in the high-temperature portion.

DESCRIPTION OF THE PREFERRED EMBODIMENT

Figure 1:
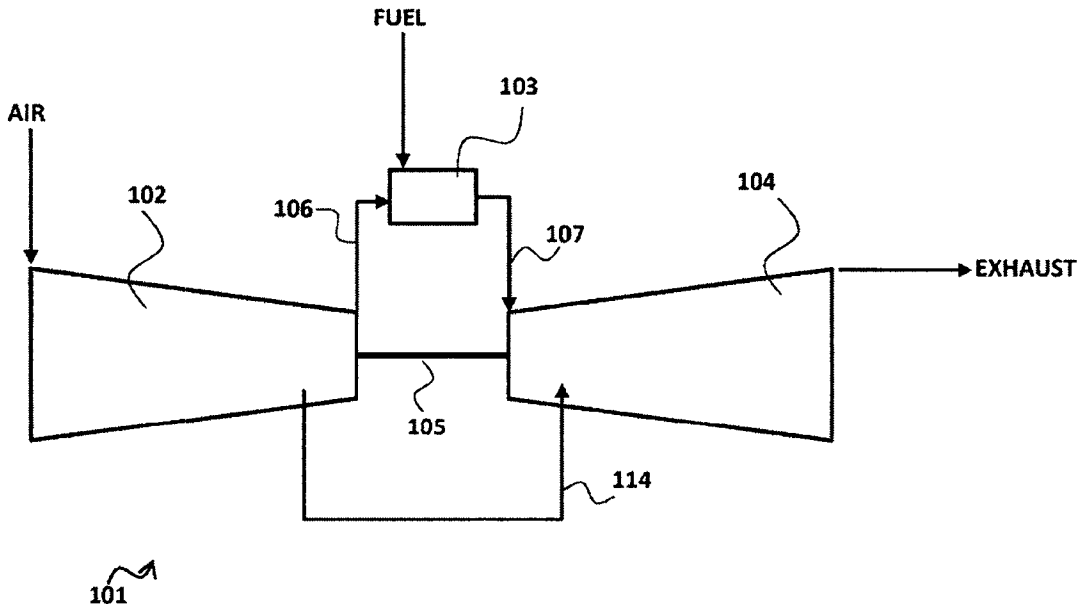
FIG. 1 is a system configuration diagram of a gas turbine according to an embodiment of the present invention.

The gas turbine according to the embodiment of the present invention will now be described with reference to the accompanying drawings. FIG. 1 is the system configuration diagram of the gas turbine according to the embodiment of the present invention.

Referring to FIG. 1, a gas turbine 101 mainly includes a compressor 102, a combustor 103, and a turbine 104. The compressor 102 sucks and compresses atmospheric air to generate compressed air 106 and delivers the thus generated compressed air 106 to the combustor 103. The combustor 103 mixes the compressed air 106 generated by the compressor 102 with fuel supplied via a fuel flow control valve (not shown) and burns the mixture to generate combustion gas 107. The combustor 103 leads out the combustion gas 107 into the turbine 104.

The combustion gas 107 led from the combustor 103 into the turbine 104 is jetted to the rotor blade via the stator blade to rotate a turbine shaft 105. The rotational force of the turbine shaft 105 drives the compressor 102 and an apparatus such as a generator (not shown) connected to the turbine 104. The combustion gas 107 whose energy has been recovered by the turbine 104 is discharged as exhaust gas to the atmosphere via an exhaust diffuser (not shown).

Either a portion of the air compressed by the compressor 102 or the air bled from an intermediate stage of the compressor 102 is led to the turbine 104 through a cooling passage 114 and used as cooling air for the stator blade, the rotor blade, and other parts provided on the turbine.

Figure 2:
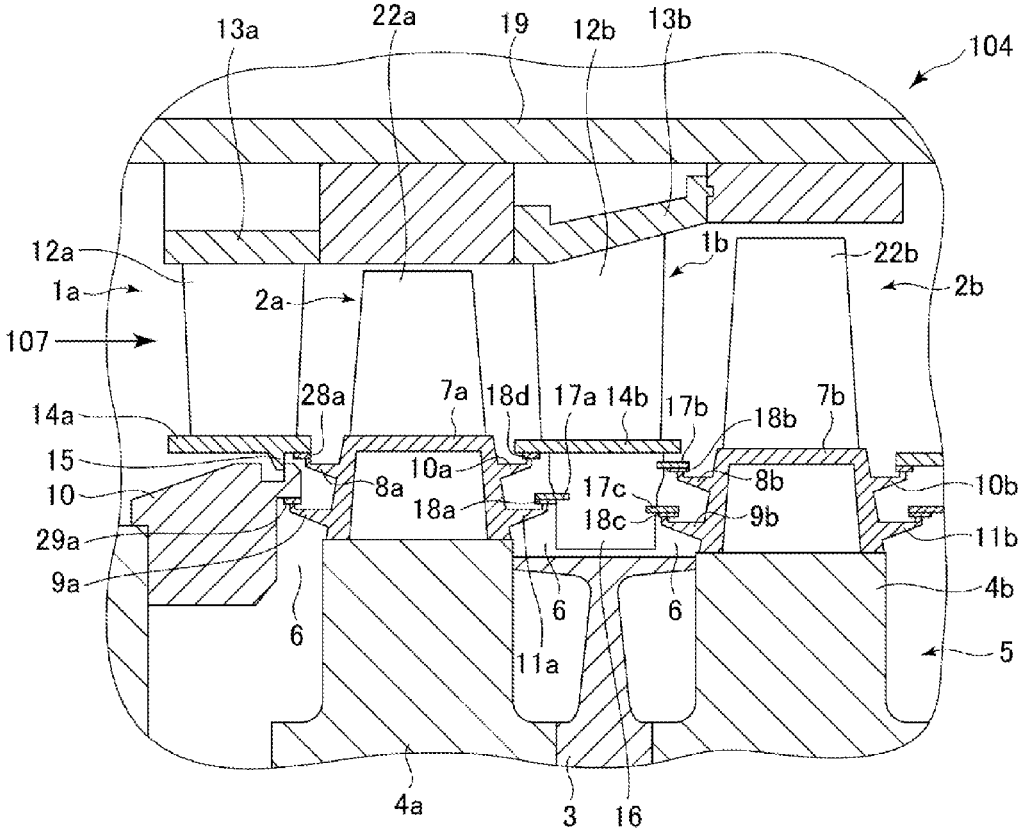
FIG. 2 is a cross-sectional view of a turbine portion of the gas turbine according to the embodiment of the present invention.

A configuration of the gas turbine according to the embodiment of the present invention is next described with reference to FIG. 2. FIG. 2 is the cross-sectional view of the turbine portion of the gas turbine according to the embodiment of the present invention. Specifically, FIG. 2 illustrates a first and a second stage of the turbine portion.

Referring to FIG. 2, a first-stage rotor blade 2*a*, which has a rotor blade profile portion 22*a* and a first-stage rotor blade shank 7*a*, is secured to a first-stage disk wheel 4*a* via the first-stage rotor blade shank 7*a*. A second-stage rotor blade 2*b*, which has a rotor blade profile portion 22*b* and a second-stage rotor blade shank 7*b*, is secured to a second-stage disk wheel 4*b* via the second-stage rotor blade shank 7*a*.

A disk spacer 3 is disposed between the first-stage disk wheel 4*a* and the second-stage disk wheel 4*b* so as to correspond to the position of a second-stage stator blade 1*b*. The first-stage disk wheel 4*a*, the second-stage disk wheel 4*b*, and the disk spacer 3 are fastened by a stacking bolt (not shown) to form a rotor 5 as a rotating body.

Seal fins (8*a*, 9*a* and 10*a*, 11*a*) are radially provided on one side and the other side, respectively, of the first-stage rotor blade shank 7*a*. Seal fins (8*b*, 9*b* and 10*b*, 11*b*) are radially provided on one side and the other side, respectively, of the second-stage rotor blade shank 7*b*.

Meanwhile, a first-stage stator blade 1*a* includes a stator-blade profile portion 12*a*, a first-stage outer circumferential end wall 13*a* provided on the outer circumferential side of the stator-blade profile portion 12*a*, and a first-stage inner circumferential end wall 14*a* provided on the inner circumferential side of the stator-blade profile portion 12*a*. The first-stage stator blade 1*a* is arranged in an annular manner. A convex hook 15 is formed on the inner-diameter side of the first-stage inner circumferential end wall 14*a*. The first-stage stator blade 1*a* is held via the hook 15 on a support ring 10 mounted to a casing 19.

A ceramic abradable coating 28*a* is applied to a portion of the first-stage inner circumferential end wall 14*a* facing the inner-diameter side seal fin 8*a*. Similarly, a ceramic abradable coating 29*a* is applied to a portion of the support ring 10 facing the inner-diameter side seal fin 9*a*. The applied portions of the ceramic abradable coatings (28*a*, 29*a*) and the seal fins (8*a*, 9*a*) form a sealing device.

A wheel space 6, which is a clearance defined between the stationary body and the rotating body, is defined by the inside-diameter side of the first-stage inner circumferential end wall 14*a*, the inner-diameter side of the support ring 10, the outside-diameter side of the first-stage disk wheel 4*a*, and the first-stage rotor blade shank 7*a*.

The second-stage stator blade 1*b* includes a blade profile portion 12*b*, a second-stage outer circumferential end wall 13*b* provided on the outer circumferential side of the blade profile portion 12*b*, and a second-stage inner circumferential end wall 14*b* provided on the inner circumferential side of the blade profile portion 12*b*. The second-stage stator blade 1*b* is arranged in an annular manner. A diaphragm 16 is attached to the inside-diameter side of the second-stage inner circumferential end wall 14*b*. The diaphragm 16 has fins (17*a*, 17*b*, 17*c*) located to face the seal fins (11*a*, 8*b*, 9*b*), respectively.

A ceramic abradable coating 18*d* id applied to a portion of the second-stage inner circumferential end wall 14*b* facing the inside-diameter side seal fin 10*a*. Ceramic abradable coatings (18*a*, 18*b*, 18*c*) are applied to respective positions facing the fins (17*a*, 17*b*, 17*c*), respectively, of the diaphragm 16. The applied portions of the abradable coatings (18*a*, 18*b*, 18*c*, 18*d*) and the seal fins (11*a*, 8*b*, 9*b*, 10*a*) form the sealing device.

The wheel space 6, which is a clearance defined between the stationary body and the rotating body, is defined by the inner-diameter side of the second-stage inner circumferential end wall 14*b*, the outer-diameter side of the spacer 3, and the first-stage and second-stage rotor blade shanks (7*a*, 7*b*).

In the present embodiment with such constitution as above, the high-temperature and high-pressure combustion gas 107 generated by the compressor 102 and the combustor 103 passes through the first-stage stator blade 1*a*, the first-stage rotor blade 2*a*, the first-stage stator blade 1*b*, and the second-stage stator blade 2*b* upon the operation of the gas turbine. At this time the combustion gas 107 is about to enter the inside of the wheel space 6. Meanwhile, a portion of the high-pressure air obtained in the compressor 102 is bled and supplied as cooling air toward the wheel space 6. Such cooling air dilutes the leaking combustion gas 107 to lower the temperature in an area around these sealing devices, thereby suppressing the entering of the combustion gas into the wheel space 6.

Figure 3:
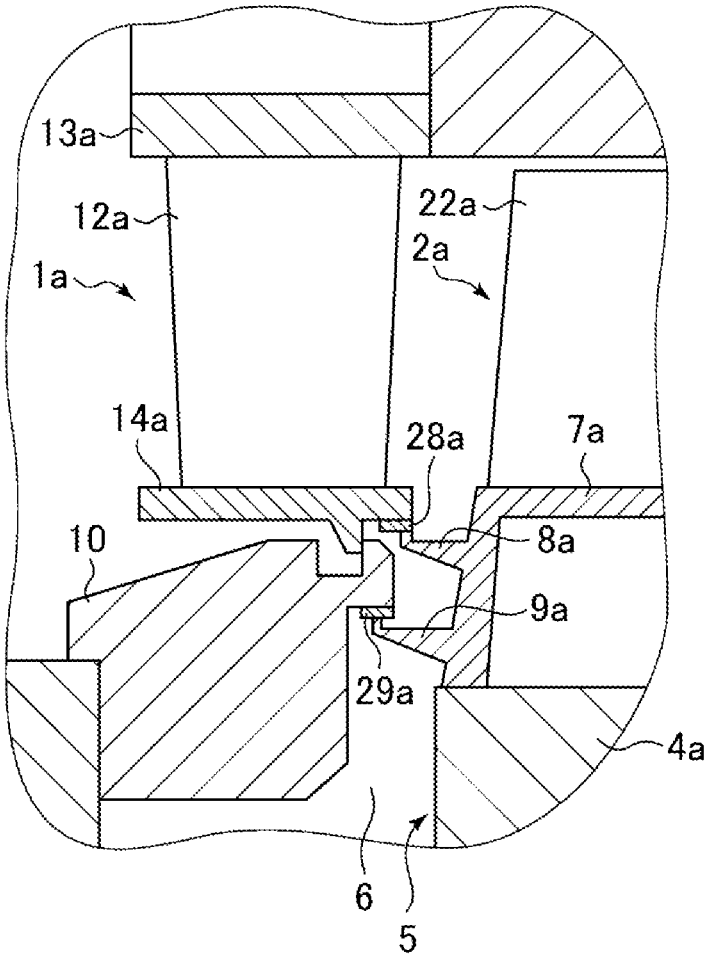
FIG. 3 is a cross-sectional view of a sealing device of the gas turbine according to the embodiment of the present invention.

The sealing device according to the embodiment of the present invention is next described with reference to FIG. 3. FIG. 3 is the cross-sectional view of the sealing device according to the embodiment of the present invention. The same portions in FIG. 3 as those in FIGS. 1 and 2 are denoted by like reference numerals and their detailed explanations are omitted.

FIG. 3 illustrates the first-stage stator blade 1*a*, the first-stage rotor blade 2*a*, and the wheel space 6 shown in FIG. 2 on an enlarged scale.

In general, a seal clearance exists between the inside-diameter side of the support ring 10 and the seal fin 9*a* and between the inside-diameter side of the first-stage inner circumferential end wall 14*a* and the seal fin 8*a*. The seal clearance is narrowed or enlarged depending on an operating condition of the gas turbine. Therefore, such seal clearance is set so as to prevent the seal fins (8*a*, 9*a*) and the stationary body from coming into contact with each other to be damaged. An amount of cooling air supplied from the compressor 102 is set according to a size of the seal clearance. A variation in the seal clearance occurs due to a difference between an amount of thermal expansion of the casing 19 and an amount of thermal expansion of the rotor 5 resulting from thermal change. When objects that have a same material have a same temperature change, the amount of thermal expansion is proportional to length of the objects to be compared. The gas turbine has an axially long structure; therefore, variation width of the axial seal clearance is greater than that of the radial seal clearance. The radial seal clearance is designed to be smaller than the axial seal clearance for this reason.

In the present embodiment, as shown in FIG. 3, a ceramic abradable coating 29*a* is applied to the inside-diameter side of the support ring 10 to which the leading end of the seal fin 9*a* is opposed. A ceramic abradable coating 28*a* is applied to the inside-diameter side of the first-stage inner circumferential end wall 14*a* to which the leading end of the seal fin 8*a* is opposed. The seal clearance of these is narrowed to form a sealing device. The ceramic abradable coatings (28*a*, 29*a*) applied to the corresponding inside-diameter sides of the first-stage inner circumferential end wall 14*a*, and the support ring 10 which are a stationary body facing the seal fins (8*a*, 9*a*) have a small thickness to narrow the associated radial seal clearance. The ceramic abradable coatings (28*a*, 29*a*) are each formed to have an axial size greater than that of a corresponding seal fin of the leading ends of the seal fins (8*a*, 9*a*) facing each ceramic abradable coating. This is because the gas turbine has a large axial variation width.

Figure 4:
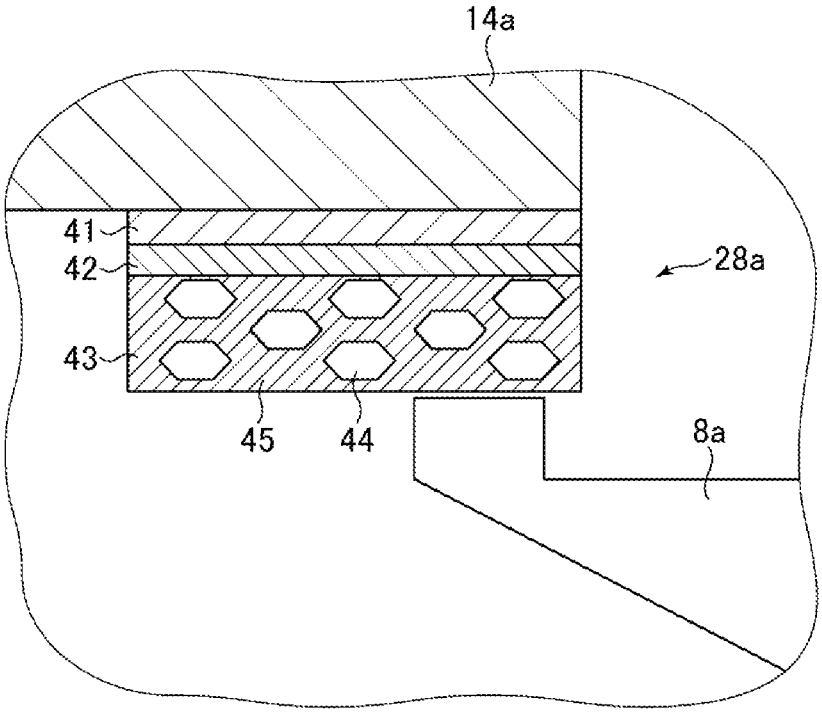
FIG. 4 is a cross-sectional view illustrating a ceramic abradable coating of the sealing device of the gas turbine according to the embodiment of the present invention.

The ceramic abradable coating according to the present embodiment is next described with reference to FIG. 4. FIG. 4 is the cross-sectional view illustrating the ceramic abradable coating of the sealing device of the gas turbine according to the embodiment of the present invention. The ceramic abradable coating having a sealing structure is disclosed in detail in JP-2010-151267-A. The same portions in FIG. 4 as those in FIGS. 1 to 3 are denoted by like reference numerals and their detailed explanations are omitted.

FIG. 4 illustrates the ceramic abradable coating 28*a* applied to the inside-diameter side portion of the first-stage inner circumferential end wall 14*a*, which is one of the members constituting the sealing device. In FIG. 4, the abradable coating 28*a* has an underlying layer 41 provided on the inside-diameter side portion of the first-stage inner circumferential end wall 14*a*, a cellular ceramic heat barrier 42, and a ceramic layer 43 with cellular structure provided on the heat barrier 42.

The ceramic layer 43 with cellular structure has thin film-form ceramics extending along outer shells of bubbles 44 to surround them in a reticulated structure. This thin film-form ceramics are easily broken and dropped off by sliding to exhibit machinability and act as an abradable coating.

According to the gas turbine of the embodiment of the invention described above, the seal fin 8*a* is provided on the shank portion 7*a* of the rotor blade 2*a* that is the rotating body on the upstream side of the turbine portion. The ceramic abradable coating 28*a* is applied to an inside-diameter surface of the first-stage end wall 14*a* of the first-stage stator blade 1*a* that is the stationary body facing the seal fin 8*a*. The seal performance can be improved thereby even in the high-temperature portion.

According to the embodiment of the gas turbine of the present invention described above, even if the radial seal clearance is narrowed to bring the seal fins (8*a*, 9*a*) and the stationary body into contact with each other during the operation of the gas turbine, the ceramic abradable coatings (28*a*, 29*a*) are easily ground. Therefore, the damage due to this contact will not occur. Thus, the radial seal clearance can be narrowed as much as the radial thickness of each of the abradable coatings (28*a*, 29*a*), compared to the volume of the seal clearance set to avoid the contact between conventional seal fins (8*a*, 9*a*) as a rotating body and a stationary body.

According to the embodiment of the gas turbine of the present invention, since the volume of the radial seal clearance is set smaller than that of the axial seal clearance the application of the ceramic abradable coating having a small thickness can effectively improve the seal performance with respect to the radial seal clearance. The improvement in seal performance can reduce seal air supplied to the wheel space 6, improving the performance of the gas turbine as a result.

According to the embodiment of the gas turbine of the present invention, further, the ceramic abradable coating which can exhibit abradability even under high temperature is applied to each of the inner circumferential surface of the first-stage end wall 14*a* of first-stage stator blade 1*a* on the upstream side with a high seal air flow rate that requires high seal performance and the circumferential surface of the support ring 10 which supports the initial stator blade 1*a* so as to reduce the seal air flow rate more effectively.

Incidentally, the embodiment of the present invention describes as an example the case where the ceramic abradable coating 28*a* is applied to the inside-diameter surface of the first-stage inner circumferential end wall 14*a* facing the seal fin 8*a* provided on the first-stage rotor blade shank 7*a* as well as the case where the ceramic abradable coating 29*a* is applied to the inside-diameter surface of the support ring 10 facing the seal fin 9*a* provided on the first-stage rotor blade shank 7*a*. However, the present invention is not limited to this as the ceramic abradable coating may be applied to either of the inside-diameter surface of the first-stage inner circumferential end wall 14*a* and the inside-diameter surface of the support ring 10.

It is to be noted that the present invention is not limited to the aforementioned embodiments, but covers various modifications. While, for illustrative purposes, those embodiments have been described specifically, the present invention is not necessarily limited to the specific forms disclosed. Thus, partial replacement is possible between the components of a certain embodiment and the components of another. Likewise, certain components can be added to or removed from the embodiments disclosed.

What is claimed is:

1. A gas turbine comprising:

disk wheels of which a rotor is formed;

a rotor blade including a shank and a rotor blade profile portion, the shank being mounted on the outer circumference of each of the disk wheels;

a first-stage stator blade including a stator blade profile portion and an inner circumferential end wall provided at the stator blade profile portion on the side of the inner circumference of the stator blade profile portion; and a seal fin provided on the shank of the rotor blade in such a manner that the seal fin faces an inside-diameter surface lying on the inner circumferential end wall of the stator blade; wherein an abradable coating is applied to a portion of the inside-diameter surface of the first-stage stator blade lying on the inner circumferential end wall of the first-stage stator blade and facing the seal fin on the shank;

the abradable coating is a ceramic abradable coating applied to the portion of the inside-diameter surface of the first-stage stator blade, to which high-temperature and high-pressure combustion gas is led from a combustor; and the ceramic abradable coating has an underlying layer provided on an inside-diameter side portion of the inner circumferential end wall of the first-stage stator blade, a cellular ceramic heat barrier and a ceramic layer with cellular structure being provided on the heat barrier.

2. The gas turbine according to claim 1, wherein the ceramic abradable coating is applied to a portion of an inside-diameter surface of a support ring supporting the first-stage stator blade to which the high-temperature and high-pressure combustion gas is led from the combustor.

3. The gas turbine according to claim 1, wherein a sealing device composed of the inside-diameter surface of the inner circumferential end wall and the seal fin narrows a radial seal clearance by a thickness of at least one of the applied abradable coating and the ceramic abradable coating.

4. The gas turbine according to claim 1, wherein a ceramic abradable coating is further applied to a stator blade side portion facing a seal fin provided on a downstream side of the rotor blade.

5. The gas turbine according to claim 1, wherein the ceramic abradable coating is applied to have an axial size greater than the axial size of a leading end of the seal fin.

* * * * *